US008542150B2

(12) United States Patent
Rötter

(10) Patent No.: US 8,542,150 B2
(45) Date of Patent: Sep. 24, 2013

(54) PLANAR BROADBAND ANTENNA

(75) Inventor: Gerhard Rötter, Veitsbronn (DE)

(73) Assignee: Siemens Aktiengesellschaft, Munich (DE)

( * ) Notice: Subject to any disclaimer, the term of this patent is extended or adjusted under 35 U.S.C. 154(b) by 540 days.

(21) Appl. No.: 12/808,581

(22) PCT Filed: Dec. 17, 2007

(86) PCT No.: PCT/EP2007/011068

§ 371 (c)(1),
(2), (4) Date: Nov. 24, 2010

(87) PCT Pub. No.: WO2009/076986

PCT Pub. Date: Jun. 25, 2009

(65) Prior Publication Data

US 2011/0057845 A1 Mar. 10, 2011

(51) Int. Cl.
*H01Q 1/38* (2006.01)

(52) U.S. Cl.
USPC ..... 343/700 MS; 343/846

(58) Field of Classification Search
USPC ..... 343/700 MS, 846, 848, 767
See application file for complete search history.

(56) References Cited

U.S. PATENT DOCUMENTS

| | | | | |
|---|---|---|---|---|
| 6,914,573 | B1 | 7/2005 | McCorkle | |
| 7,019,699 | B2 * | 3/2006 | Komatsu et al. | 343/711 |
| 7,199,758 | B2 * | 4/2007 | Ikeda et al. | 343/700 MS |
| 7,227,500 | B2 * | 6/2007 | Oshima et al. | 343/700 MS |

FOREIGN PATENT DOCUMENTS

| | | |
|---|---|---|
| EP | 1 437 792 | 7/2004 |
| EP | 1 513 224 | 3/2005 |
| JP | 8148921 | 6/1996 |
| JP | 2002-252520 | 9/2002 |

* cited by examiner

*Primary Examiner* — Hoang V Nguyen
(74) *Attorney, Agent, or Firm* — Cozen O'Connor

(57) ABSTRACT

A planar antenna comprising a planarly configured inner radiation element that is surrounded by an outer radiation element, wherein the inner and outer radiation elements each have a feed point. A continuous or discontinuous modification of the distance, which is equal in relation to a symmetrical axis of the inner radiation element, exists between the inner radiation element and the outer radiation element. The distance between the outer and the inner radiation element is different in the area of the two feed points from that in the area facing away from the feed points.

10 Claims, 2 Drawing Sheets

PLANAR BROADBAND ANTENNA

CROSS-REFERENCE TO RELATED APPLICATIONS

This is a U.S. national stage of International Application No. PCT/EP2007/011068, filed on 17 Dec. 2007.

BACKGROUND OF THE INVENTION

1. Field of the Invention

The invention relates to antennas and, more particularly, to a planar antenna with a planar, inner antenna element, which is surrounded by an outer antenna element, where the inner antenna element and the outer antenna element each have a feed point.

2. Description of the Related Art

EP 1 437 792 B1 discloses a planar antenna that forms part of a cavity slot antenna for automobiles. The inner antenna element has a hexagonal shape. It is surrounded by a square loop, which acts as a grounding conductor.

EP 1 513 224 A1 discloses another planar antenna. This planar antenna has an antenna element with an approximately square basic shape. Here, however, two opposite corners of the square basic shape have been milled away. Consequently, the two diagonals, which are orthogonal to one another, of the approximately square basic shape have different lengths. An annular grounding face is also provided. This grounding face opens up in its interior to a square area, into which the antenna element is inserted. Here, the antenna element assumes a uniform distance from the inner edge of the annular grounding face, as far as the regions of the two defined corners. Finally, connection contact points for the antenna element and the grounding face are provided. These connection contact points are placed opposite one another at two side edges of the antenna element and the grounding face outside the diagonal.

U.S. Pat. No. 6,914,573 B1 discloses a small, planar antenna with a large bandwidth. This antenna has a grounding face with a rectangular outer contour which is symmetrical with respect to an axis. An approximately oval free area is located in the interior of the grounding face, and a likewise approximately oval antenna area is inserted symmetrically into the free face. The antenna area includes a connecting line that is passed to the outside through the grounding area by way of a gap lying on the axis of symmetry. Here, the width of the free area does not decrease, when viewed from the connecting line to a point opposite the connecting line. However, the width of the free area is tapered in the two symmetrical regions in the direction towards the connecting line to achieve a uniform impedance transition.

A coplanar antenna structure, which is as broadband as possible, is required for various applications, such as for use in Ultra High Frequency-Radio Frequency Identification (UHF-RFID) transponders. Read and write devices for UHF transponders in the conventional frequency band of 865 MHz to 960 MHz need only operate in a specific frequency band dependent on the regulations of the country where the system is being used. Objects which are intended to be identified by transponders are often used across borders. Therefore, transponders with a detection range in a large frequency band are of importance. Large detection ranges are only possible when the antenna system of a transponder can supply sufficient energy to the RFID semiconductor component.

SUMMARY OF THE INVENTION

It is therefore an object of the invention to provide a planar antenna which enables broadband operation.

This and other objects and advantages are achieved in accordance with the invention by providing a continuous or discontinuous change in the distance between the inner antenna element and the outer antenna element, where the change is identical with respect to an axis of symmetry of the inner antenna element, and the distance between the outer antenna element and the inner antenna element in the region of the two feed points is different than that in the region remote from the feed points.

The contemplated embodiments of the antenna make it possible to achieve a continuous transformation of the impedance at the feed point to the characteristic impedance of the free space. The continuous transformation results in a virtually constant emission response in the operational frequency range of the antenna. Here, the outer antenna element can in this case also be open in the region remote from the feed points.

A particularly advantageous embodiment of the invention is provided if the inner antenna element comprises an isosceles triangle. As a result, an antenna element which is inhomogeneous in the sense of the theory of conduction is achieved. Here, the edges of the antenna can also extend exponentially, instead of as straight limbs.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

Exemplary embodiments of the invention will be explained in more detail below with reference to a drawing, in which.

DETAILED DESCRIPTION OF THE PREFERRED EMBODIMENTS

Figure 1:
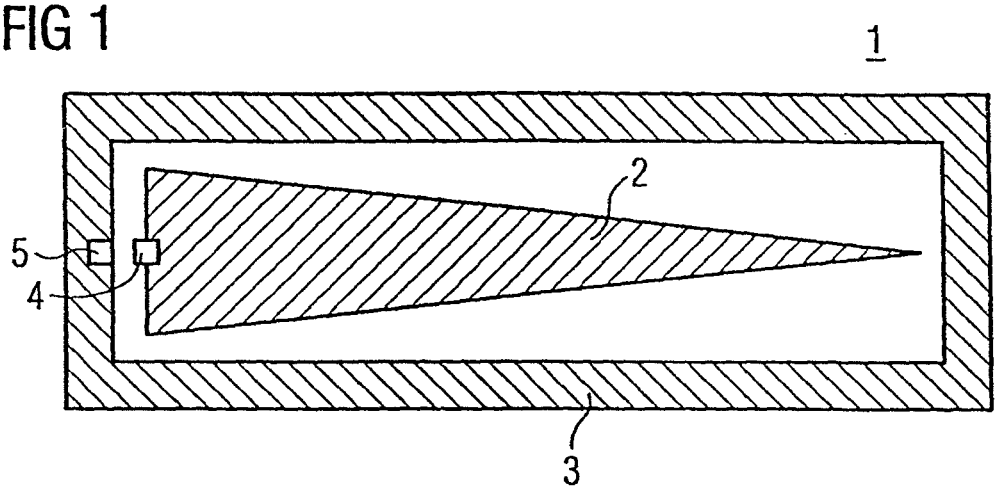
FIG. 1 is a plan view an antenna in accordance with an embodiment of the invention.
Figure 2:
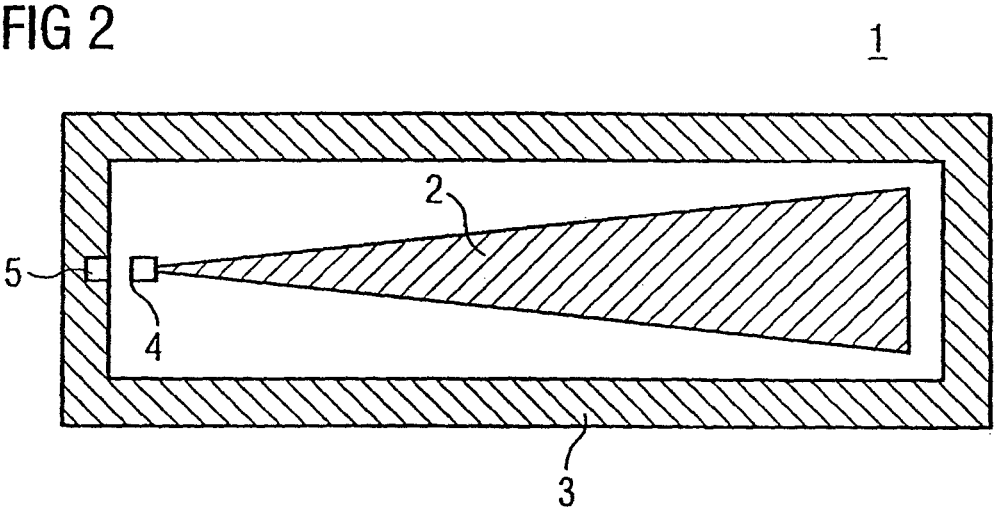
FIG. 2 is a plan view of an antenna in accordance with an alternative embodiment of the invention.

Two embodiments of a planar antenna 1 in accordance with the invention are illustrated in FIGS. 1 and 2. The antenna 1 has an inhomogeneous, inner antenna element 2, which in this case comprises an isosceles triangle, and an outer antenna element 3, which surrounds the inner antenna element and comprises a closed loop. In the exemplary embodiment shown in FIG. 1, a first feed point 4 is provided in the center of the base of the triangular, inner antenna element 2 and, opposite to this, a second feed point 5 is provided on the outer antenna element 3 comprising the loop. In the exemplary embodiment shown in FIG. 2, a tip of the triangular, inner antenna element 3 with the feed point 4 is directly opposite the feed point 5 of the outer antenna element 3.

Figure 3:
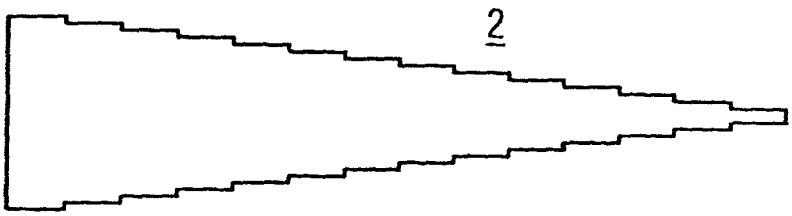
FIG. 3 is a schematic view of an embodiment of an inner antenna element with a discontinuous contour.
Figure 4:
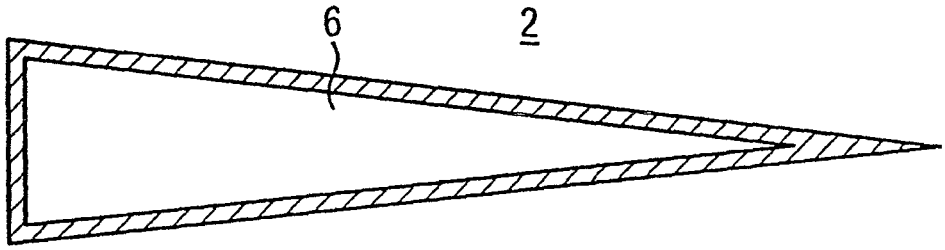
FIGS. 4, 5 and 6 are plan views of various embodiments of an inner antenna element.
Figure 5:
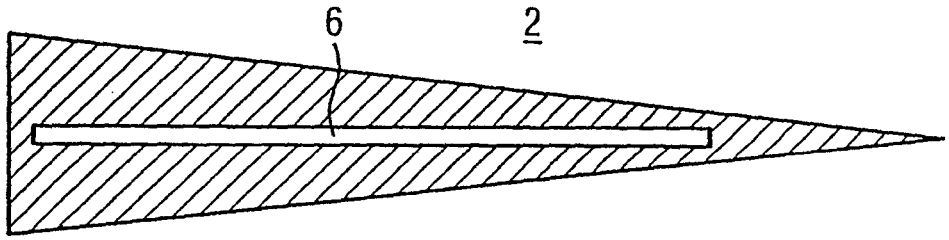
Figure 6:
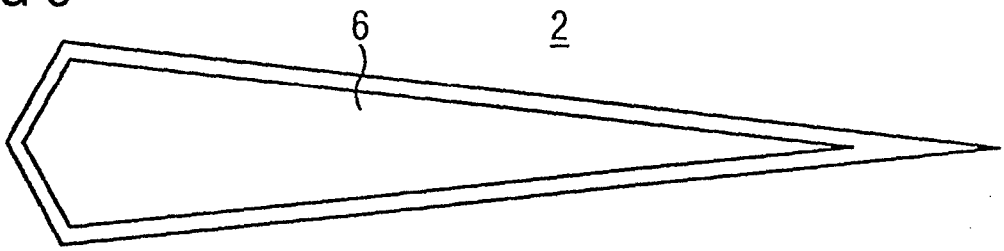

The triangular, inner antenna element 2 illustrated is, in the sense of the theory of conduction, an inhomogeneous antenna element, whose limbs can run continuously, and also discontinuously, as illustrated in FIG. 3. The area of the inner antenna element 2 which in this case is completely filled can also have a cutout 6 with a different shape, as illustrated in FIGS. 4, 5 and 6, inter alia a slot, for example, however.

Ideally, the complex impedance and the emission response of an antenna are constant within a frequency band. In reality, however changes in the complex impedance of the antenna occur as a function of the frequency. The smaller these changes are in the given frequency band, the more the contemplated embodiment can be referred to as broadband. This property can be achieved by self-similar or self-complementary geometric structures. Self-similar structures, when enlarged, demonstrate identical or comparable properties to those in the initial state. This is intended to mean the similarity of the inner antenna element 3 with the cutout which results from the limitation with the outer, closed or partially closed, rectangular loop. The loop must be closed or continuous in the region of the inner antenna element 2. The extent of the largest dimension of the inner antenna element 2 is in the region of one quarter of the wavelength of the operating frequency.

Figure 7:
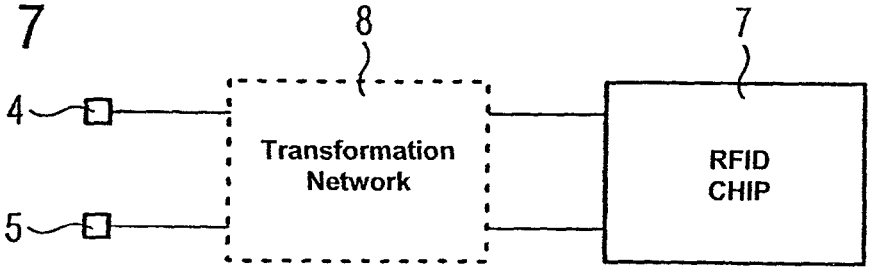
FIG. 7 is a schematic diagram of an arrangement with the antenna in accordance with the contemplated embodiments of the invention in conjunction with a chip.

In order to be able to operate the antenna 1 in accordance with the disclosed and described embodiments and a radiofrequency identification (RFID) chip 7 or semiconductor with power matching, the use of a transformation network 8 as shown in FIG. 7 is possible. The transformation network 8 (illustrated by dashed lines), which is connected to the feed points 4, 5, is optional, i.e., the connection without concentrated elements is possible in the case of a suitable semiconductor impedance.

For impedance transformation, the positioning of the two feed points 4, 5 is also decisive. The practical embodiment demands that the RFID chip 7 be placed between the illustrated feed points 4, 5 since bonding wires produce the electrical connection between the RFID chip and the antenna 1. The minimum geometric distance needs to be implemented for the connection between the outer antenna element 3 and the RFID chip and between said RFID chip and the planar, inner antenna element 2. Preferably, the connections need to be made in the vicinity of the line of symmetry. For impedance matching, the positioning of the RFID chip and the connections between the RFID chip and the antenna elements 2, 3 may be possible at points where the minimum geometric distance is likewise provided. In practice, housing shapes which contain the connection by bonding wires between the RFID chip and the connection pads and are known as surface-mounted components likewise exist. For this housing technology (e.g., SMD surface mounted device or SMT surface mounted technology), the minimum geometric distance between the connection and the antenna elements 2, 3 is likewise advantageous.

In an operational frequency band of from 865 MHz to 930 MHz, RFID semiconductors demonstrate a capacitive impedance response with losses between the connection gates of the RFID semiconductors. The antenna 1 demonstrates a complex impedance in the inductive range between the feed points 4, 5. In the most favorable case, capacitive and inductive portions are precisely eliminated when the RFID chip and the antenna 1 are connected to one another. If the inductive portion of the antenna 1 should prove to be insufficient for complete compensation, the addition of corresponding portions by virtue of a concentrated component or a power element with the correspondingly required inductive portion is possible. In this case, the outer antenna element 3, i.e., the loop, is configured to be continuous, i.e., closed, in the region of the feed points 4, 5.

The inner antenna element 2 and the outer antenna element 3 do not necessarily need to be located on one plane. However, this is advantageous for practical implementation.

The antenna 1 in accordance with the contemplated embodiments of the invention can be applied to a nonconductive carrier and can be arranged opposite a metal pad. With the antenna 1 configured in accordance with the disclosed embodiments of the invention, there then results a change in the impedance between the feed points 4, 5, but to a lesser degree than in the case of a dipole antenna with comparable dimensions.

Thus, while there have been shown, described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A planar antenna, comprising:

an inner antenna element configured as an isosceles triangle; and an outer antenna element surrounding the inner antenna element, the inner antenna element and the outer antenna element each having a feed point;

wherein a continuous or discontinuous change is provided in a distance between the inner antenna element and the outer antenna element, the continuous or discontinuous change being identical with respect to an axis of symmetry of the inner antenna element;

wherein the distance between the outer antenna element and the inner antenna element in a region of the feed points of the inner and outer antenna elements being different than in a region remote from the feed points of the inner and outer antenna elements; and wherein each feed point of the inner and outer antenna elements is arranged in a vicinity of the axis of symmetry of the inner antenna element.

2. The planar antenna as claimed in claim 1, wherein the inner antenna element and the outer antenna element are disposed in a same plane.

3. The planar antenna as claimed in claim 1, wherein the inner antenna element and the outer antenna element are disposed in a same plane.

4. The planar antenna as claimed in claim 1, wherein the inner antenna element includes a cutout.

5. The planar antenna as claimed in claim 4, wherein the cutout is configured as a slot.

6. The planar antenna as claimed in claim 1, wherein a longitudinal extent of the inner antenna element is approximately one quarter of a wavelength of an operational frequency of the planar antenna.

7. The planar antenna as claimed in claim 1, wherein the planar antenna is implemented in a radio frequency identification (RFID) transponder.

8. The planar antenna as claimed in claim 1, wherein the outer antenna element is arranged in a loop.

9. The planar antenna as claimed in claim 1, wherein the outer antenna element provides a return conductor system.

10. The planar antenna as claimed in claim 1, wherein the inner antenna element is planar.

* * * * *